US008833756B2

(12) United States Patent
Nakayama

(10) Patent No.: US 8,833,756 B2
(45) Date of Patent: Sep. 16, 2014

(54) SHEET-SHAPED MEDIUM FEEDING DEVICE AND SHEET-SHAPED MEDIUM PROCESSING DEVICE

(75) Inventor: Hiroyuki Nakayama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/615,775

(22) Filed: Sep. 14, 2012

(65) Prior Publication Data

US 2013/0087966 A1 Apr. 11, 2013

(30) Foreign Application Priority Data

Oct. 7, 2011 (JP) ..... 2011-222590

(51) Int. Cl.

| | |
|---|---|
| ***B65H 3/06*** | (2006.01) |
| ***B65H 3/52*** | (2006.01) |
| ***B41J 3/44*** | (2006.01) |
| ***B65H 1/02*** | (2006.01) |

(52) U.S. Cl.

CPC ..... *B41J 3/44* (2013.01); *B65H 3/0653* (2013.01); *B65H 3/0669* (2013.01); *B65H 2701/1912* (2013.01); *B65H 2403/422* (2013.01); *B65H 1/025* (2013.01)

USPC ..... 271/116; 271/117; 271/126

(58) Field of Classification Search

USPC ..... 271/10.05, 10.13, 117, 116

See application file for complete search history.

(56) References Cited

U.S. PATENT DOCUMENTS

| | | | | |
|---|---|---|---|---|
| 5,854,695 | A * | 12/1998 | Cho | 358/498 |
| 5,873,441 | A * | 2/1999 | Tsujishita | 192/46 |
| 6,024,357 | A * | 2/2000 | Sheng | 271/10.13 |
| 7,056,047 | B2 | 6/2006 | Sasaki et al. | |
| 7,392,979 | B2 * | 7/2008 | Sasaki et al. | 271/120 |
| 7,435,023 | B2 | 10/2008 | Sasaki et al. | |
| 7,594,650 | B2 * | 9/2009 | Chung et al. | 271/116 |
| 7,651,083 | B2 * | 1/2010 | Embury et al. | 271/127 |
| 7,770,793 | B2 | 8/2010 | Sasaki et al. | |
| 8,038,142 | B2 * | 10/2011 | Sasaki | 271/127 |
| 8,061,914 | B2 | 11/2011 | Sasaki et al. | |
| 8,109,502 | B2 | 2/2012 | Mizuyama | |
| 8,186,667 | B2 * | 5/2012 | Hirabayashi et al. | 271/10.13 |
| 8,348,260 | B2 * | 1/2013 | Bakker et al. | 271/157 |
| 8,485,519 | B2 * | 7/2013 | Sasaki | 271/125 |
| 2005/0035531 | A1 * | 2/2005 | Sasaki et al. | 271/126 |
| 2009/0014943 | A1 * | 1/2009 | Sasaki | 271/10.09 |

FOREIGN PATENT DOCUMENTS

| | | | |
|---|---|---|---|
| JP | 3368667 | B2 | 1/2003 |
| JP | 2004-243764 | A | 9/2004 |
| JP | 3882426 | B2 | 2/2007 |
| JP | 2010-195510 | A | 9/2010 |

* cited by examiner

*Primary Examiner* — Kaitlin Joerger

(74) *Attorney, Agent, or Firm* — Nutter McClennen & Fish LLP; John J. Penny, Jr.

(57) ABSTRACT

A sheet-shaped medium feeding device is provided. A power transmission mechanism includes a retardation mechanism configured to retard rotation start timing of a pick-up roller than movement start timing of a pressing member when the pressing member starts to move from a stand-by position toward the pick-up roller. The retardation mechanism includes a driving side rotational member and a driven side rotational member which are configured to rotate around a common center axis. When the driving side rotational member rotates around the center axis in a predetermined rotation direction by a predetermined play angle, the driving side rotational member is engaged with the driven side rotational member to integrally rotate the driven side rotational member in the rotation direction.

9 Claims, 7 Drawing Sheets

SHEET-SHAPED MEDIUM FEEDING DEVICE AND SHEET-SHAPED MEDIUM PROCESSING DEVICE

The disclosure of Japanese Patent Application No. 2011-222590 filed on Oct. 7, 2011, including specification, drawings and claims is incorporated herein by reference in its entirety.

TECHNICAL FIELD

The present invention relates to a sheet-shaped medium feeding device for feeding a sheet-shaped medium such as a check or recording paper and a sheet-shaped medium processing device including the sheet-shaped medium feeding device, such as a check processing device, a printer, a scanner or a magnetic reading device.

BACKGROUND

In a banking service including a deposit processing and a withdrawal processing, a payment method using a check has been used. In the payment method using the check, a bank teller confirms a time and date and a signature described on the check, conducts a required deposit processing and withdrawal processing and then makes endorsement on the processed check. Further, the bank teller issues a receipt for the check processing to the customer. In addition, when the check processing is conducted, the bank teller asks a driver license or ID card for identification. As necessary, the bank teller makes a copy of the driver license or ID card by a copying machine to keep the copy. For the bank teller, it is necessary to conduct a lot of such a processing in a short time.

Patent Document 1 has suggested a complex type printing device which includes a MICR, an optical scanner, a check printing head and a receipt printing head in order to conduct the check processing in a batch at small bank windows. In this complex type printing device, a transport path which transports single sheet of paper such as the check and has U shape as seen in a plan view and a transport path which transports a continuous paper for the receipt are placed perpendicular to each other. And, a single printing head for printing the check and the receipt is disposed at an intersection of both transport paths.

The sheet-shaped medium processing device for processing a sheet-shaped medium such as the check includes a sheet-shaped medium feeding device for separating and feeding a laminated sheet-shaped medium one by one to a transport path. As the sheet-shaped medium feeding device, a device has been known which includes a mechanism for pressing the laminated sheet-shaped medium against a pick-up roller by a swivel type pressing member and for feeding the sheet-shaped medium one by one. Such a sheet-shaped medium feeding device has been suggested in Patent Document 2. In the sheet-shaped medium feeding device disclosed in Patent Document 2, the laminated sheet-shaped medium is inserted into a medium insertion part and an end of the medium insertion part on the feeding side of the sheet-shaped medium is configured as an inclined guide surface inclined from a pressing member side toward a pick-up roller side. In this way, the sheet-shaped medium fed by the pick-up roller is guided toward a narrow medium feeding port which is located at a side of the pick-up roller.

Patent Document 1: Japanese Patent Application Publication No. 2004-243764A

Patent Document 2: Japanese Patent Application Publication No. 2010-195510A

From the viewpoint of miniaturization of device and cost reduction, it is preferable that both of rotation of the pick-up roller and movement of the pressing member are performed by a single drive motor. In this case, the driving force is transmitted to both of the pick-up roller and the pressing member via a common driving force transmission pathway. Consequently, as the drive motor is rotated, the rotation of the pick-up roller and the movement of the pressing member are simultaneously started.

In the sheet-shaped medium feeding device thus configured, there is a problem that the sheet-shaped medium is fed out by the pick-up roller before a leading end of the sheet-shaped medium in a feeding direction is sufficiently pressed (approached near) against a side of a narrow medium feeding port at a feeding side end surface of a wide medium insertion part by the pressing member, depending on the setting state of the sheet-shaped medium inserted into the medium insertion part. In this case, the leading end of the sheet-shaped medium to be fed is strongly pressed against the end surface of the medium insertion part.

In a case where the inclined guide surface as disclosed in Patent Document 2 is not formed at the end surface of the medium insertion part, it is difficult to press-fit the leading end of the sheet-shaped medium to a position of the narrow medium feeding port by the pressing member, due to frictional resistance generated between a leading end surface of the sheet-shaped medium and the end surface of the medium insertion part. As a result, the leading end of the sheet-shaped medium is flexed or bent and thus the sheet-shaped medium cannot be fed out.

SUMMARY

It is therefore an object of at least one embodiment of the present invention to provide a sheet-shaped medium feeding device capable of feeding the sheet-shaped medium to the medium feeding port by the pick-up roller in a state where the sheet-shaped medium is surely approached near the narrow medium feeding port by the pressing member, irrespective of the setting state of the sheet-shaped medium. Also, another object of the present invention is to provide a sheet-shaped medium processing device such as a check processing device including the sheet-shaped medium feeding device.

According to an aspect of the embodiments of the present invention, there is provided a sheet-shaped medium feeding device comprising: a medium insertion part configured to insert a sheet-shaped medium therethrough; a medium feeding port located at an end surface of the medium insertion part at a feeding side of the sheet-shaped medium, the medium feeding port having a width narrower than a width of the medium insertion part; a pick-up roller configured to feed the sheet-shaped medium inserted into the medium insertion part to the medium feeding port; a pressing member configured to press the sheet-shaped medium against the pick-up roller; a drive motor; and a power transmission mechanism configured to transmit a driving force of the drive motor to the pick-up roller and the pressing member, wherein the power transmission is mechanism includes a retardation mechanism configured to retard rotation start timing of the pick-up roller than movement start timing of the pressing member when the pressing member starts to move from a stand-by position of the pressing member toward the pick-up roller, wherein the retardation mechanism includes a driving side rotational member and a driven side rotational member which are configured to rotate around a common center axis, and wherein when the driving side rotational member rotates around the center axis in a predetermined rotation direction by a predetermined play angle, the driving side rotational member is engaged with the driven side rotational member to integrally rotate the driven side rotational member in the rotation direction.

In the sheet-shaped medium feeding device of the present invention, owing to the retardation mechanism included in the power transmission mechanism, the rotation of the pick-up roller is started from the timing which is retarded from the movement start timing where the drive motor is rotated to start movement of the pressing member from a stand-by position toward a direction of the pick-up roller. Accordingly, after the sheet-shaped medium inserted to the medium insertion part is pressed (approached near) against the pick-up roller by the pressing member, the rotation of the pick-up roller is started. In this way, when the retardation time is properly set, a leading end of the sheet-like medium before being fed out by the pick-up roller can be approached near the narrow medium feeding port and thus it is possible to avoid a situation where the leading end of the sheet-shaped medium abuts against the end surface of the medium insertion part. Accordingly, the sheet-shaped medium can be surely fed out from the medium feeding port.

Further, as the retardation mechanism, a mechanism is employed in which a predetermined play angle in the rotation direction is provided between a driving side rotational member and a driven side rotational member which are rotated around the same center axis and the driven side rotational member is not integrally rotated unless the driving side rotational member is not rotated by the play angle. By a simple configuration in which a play is formed between the rotational members that are integrally rotated, it is possible to simply configure the retardation mechanism using a pair of the driving side rotational member and the driven side rotational member which configure the power transmission mechanism. Accordingly, increase in the number of parts and increase in the installation space can be minimized. Further, it is possible to avoid an adverse effect that the sheet-shaped medium abuts against the end surface of the medium insertion part and thus poor transport is caused, without degrading miniaturization and compactness of the sheet-shaped medium feeding device and cost reduction.

In the sheet-shaped medium feeding device, both sides of the medium insertion part in a width direction thereof may be defined by a first side surface and a second side surface which confront each other, both sides of the medium feeding port may be defined by a third side surface and a fourth side surface which confront each other, the third side surface may extend continuously to the first side surface, the fourth side surface may extend in a feeding direction of the sheet-shaped medium from a leading end of an end surface which is bent and extends toward the first side surface from an end of the second side surface at the medium insertion part, a portion of an outer peripheral surface of the pick-up roller may be exposed from the first side surface, the pressing member may be movable from the stand-by position in which the pressing member is retracted toward the second side surface from the pick-up roller, toward the portion of the outer peripheral surface of the pickup roller which is exposed at the first side surface, and the play angle of the retardation mechanism may be an angle corresponding to a rotation amount of the driving side rotational member, which is at least required for the pressing member to move from the stand-by position to a position of the fourth side surface in a width direction of the medium insertion part.

When the play angle is set as mentioned above, the sheet-shaped medium can be press-fitted to a position in which an end of the sheet-shaped medium is not brought into contact with the end surface of the medium insertion part until the pick-up roller starts to rotate, irrespective of the number of the sheet-shaped medium inserted to the medium insertion part. That is, sine the sheet-shaped medium is press-fitted by the pressing member and thus can be approached near a side of the first side surface at which the medium feeding port, the sheet-shaped medium can be surely fed out from the medium feeding port.

In the sheet-shaped feeding device, the driven side rotational member may be a roller shaft of the pick-up roller, the driving side rotational member may be a final stage transmission gear of a roller driving gear train which transmits the driving force of the drive motor of the power transmission mechanism to the roller shaft, the final stage transmission gear may be rotatably mounted on the roller shaft, the roller shaft may be mounted with an engaging pin extending in a radial direction of the roller shaft, and a first engaging surface and a second engaging surface which are engagable with the engaging pin may be formed at positions spaced apart around the rotation center axis by the play angle on an end surface of the final stage transmission gear, which confronts the engaging pin.

If the power transmission mechanism is configured by a gear train, a final stage transmission gear of the gear train is coaxially fixed to a shaft end of the roller shaft of the pick-up roller, in general. In the present invention, the final stage transmission gear is rotatably mounted on the roller shaft and a predetermined play angle is provided between the engaging pin and the engaging surface which are disposed between the roller shaft and the final stage transmission gear. Since the pick-up roller and the final stage transmission gear which are mounted on the roller shaft are spaced apart from each other by a predetermined gap in an axial direction of the roller shaft, the engaging pin and the first and second engaging surfaces can be disposed using the gap. Accordingly, since the retardation mechanism can be incorporated without the need for installation space, this retardation mechanism contributes to miniaturization of the device and cost reduction. Further, a pair of first and second engaging surfaces is formed at the final stage transmission gear. When the drive motor is rotationally driven in one direction and thus the final stage transmission gear is rotated, one engaging surface, for example, the first engaging surface is engaged with the engaging pin and thus the roller shaft is integrally rotated. In this way, it is possible to conduct the feeding operation of the sheet-shaped medium. In order to return the pressing member to the stand-by position after feeding operation is completed, when the drive motor is rotationally driven in a direction opposite to the one direction and thus the final stage transmission gear is rotated in the opposite direction, the other engaging surface, for example, the second engaging surface is engaged with the engaging pin and thus the roller shaft is integrally rotated in the opposite direction. After the drive motor is stopped, the rotation start of the pick-up roller in next operation can be surely retarded by the play angle since the play angle is formed between the first engaging surface and the engaging pin.

The sheet-shaped medium feeding device may further comprise a rotation restraint member configured to apply a rotational load to the roller shaft which is mounted with the engaging pin, in a direction to prevent the engaging pin from rotating in interlock with the final stage transmission gear until the final stage transmission gear starts to rotate and then the first engaging surface is engaged with the engaging pin.

When the engaging pin is rotated in interlock with the final stage transmission gear, the rotation is transmitted to the roller shaft mounted with the engaging pin and thus it is difficult to retard rotation start timing of the pick-up roller by the required time. According to the present invention, since the rotation restraint member gives a rotational load to prevent the engaging pin from rotating in interlock with the final stage transmission gear, it is possible to surely retard the rotation start timing of the pick-up roller by the required time.

The sheet-shaped medium feeding device, the pick-up roller may be mounted to the roller shall via a first one-way clutch, the first one-way clutch may be configured to transmit a rotation force for rotating the pick-up roller in a feeding direction of the sheet-shaped medium from the roller shaft to the pick-up roller, the power transmission mechanism may include a pressing member side transmission gear which is connected to a transmission gear of the roller driving gear train, other than the final stage transmission gear via a second one-way clutch so as to integrally rotate therewith, and a rotation force for moving the pressing member may be transmitted to the pressing member via the pressing member side transmission gear, In the sheet-shaped medium processing device for transporting the sheet-shaped medium fed out from the sheet-shaped medium feeding device and performing reading of information thereon, it is generally that the sheet-shaped medium fed out from the medium feeding port of the sheet-shaped medium feeding device is squeezed between the pair of transport rollers and then fed out along the transport path. At a timing when the sheet-shaped medium is sent to the pair of transport rollers and then rotation of the pick-up roller is stopped, a rear portion of the sheet-shaped medium is in a state of being pressed against the pick-up roller by the pressing member. As a result, a large feeding load is exerted on the sheet-shaped medium which is fed out by the pair of transport rollers and thus it is difficult to transport the sheet-shaped medium with accuracy. As the first one-way clutch is provided, the pick-up roller can rotate in interlock with the sheet-shaped medium transported by the pair of transport rollers and thus it is possible to reduce the feeding load exerted on the sheet-shaped medium.

Further, since the second one-way clutch is interposed in the power transmission path of the pressing member, a driving force above a certain level is not transmitted after the pressing member is in a state of pressing the sheet-shaped medium. Accordingly, there is no case that excessive force is applied to the pressing member. As a result, the sheet-shaped medium can be pressed against the pick-up roller with a proper pressing force by a biasing force of a spring member, etc., irrespective of the number of the sheet-shaped medium inserted into the medium insertion part According to an aspect of the embodiments of the present invention, there is provided a sheet-shaped medium processing device comprising: the above-described sheet-shaped medium feeding device; a medium transport mechanism configured to transport the sheet-shaped medium fed out from the sheet-shaped medium feeding device along a predetermined transport path; and an information reading unit configured to read out information carried on the sheet-shaped medium which is transported in the transport path. The sheet-shaped medium is surely fed out by the sheet-shaped medium feeding device and sent to the medium transport mechanism. Accordingly, it is possible to avoid an adverse effect that the sheet-shaped medium is blocked by the medium feeding port of the sheet-shaped medium feeding device and thus processing efficiency of the sheet-shaped medium is degraded. As a result, it is possible to realize the sheet-shaped medium processing device capable of effectively processing the sheet-shaped medium.

DETAILED DESCRIPTION OF THE DRAWINGS

Hereinafter, an illustrative embodiment of a sheet-shaped medium processing device including a sheet-shaped medium feeding device of the present invention will he described with reference to the accompanying drawings. The sheet-shaped medium processing device according to the present embodiment is a check processing device for processing a check which is an easily-bendable sheet-shaped medium. Further, the check processing device includes a card scanning mechanism which reads out image information on a hardly-bendable driver license or other cards for identification at the time of processing the check and a receipt issuing mechanism for issuing a receipt on which the processed information of the check is printed. Of course, the present invention may he similarly applied to a sheet-shaped medium processing device for processing a sheet-shaped medium other than the check. Further, it is of course that the present invention may be applied to a sheet-shaped medium processing device which does not include the card scanning mechanism and the receipt issuing mechanism.

(Overall Configuration)

Figure 1:
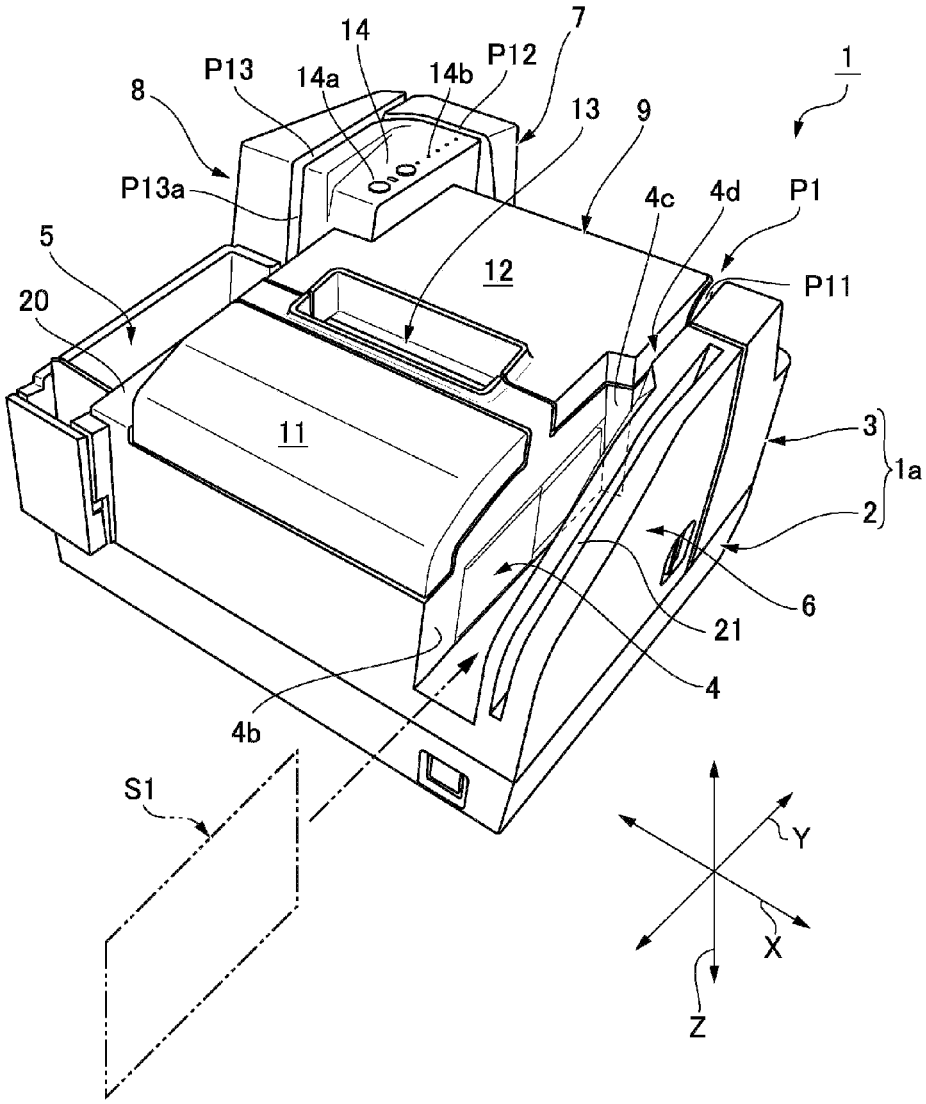
FIG. 1 is perspective view showing a check processing device of the present invention.
Figure 2:
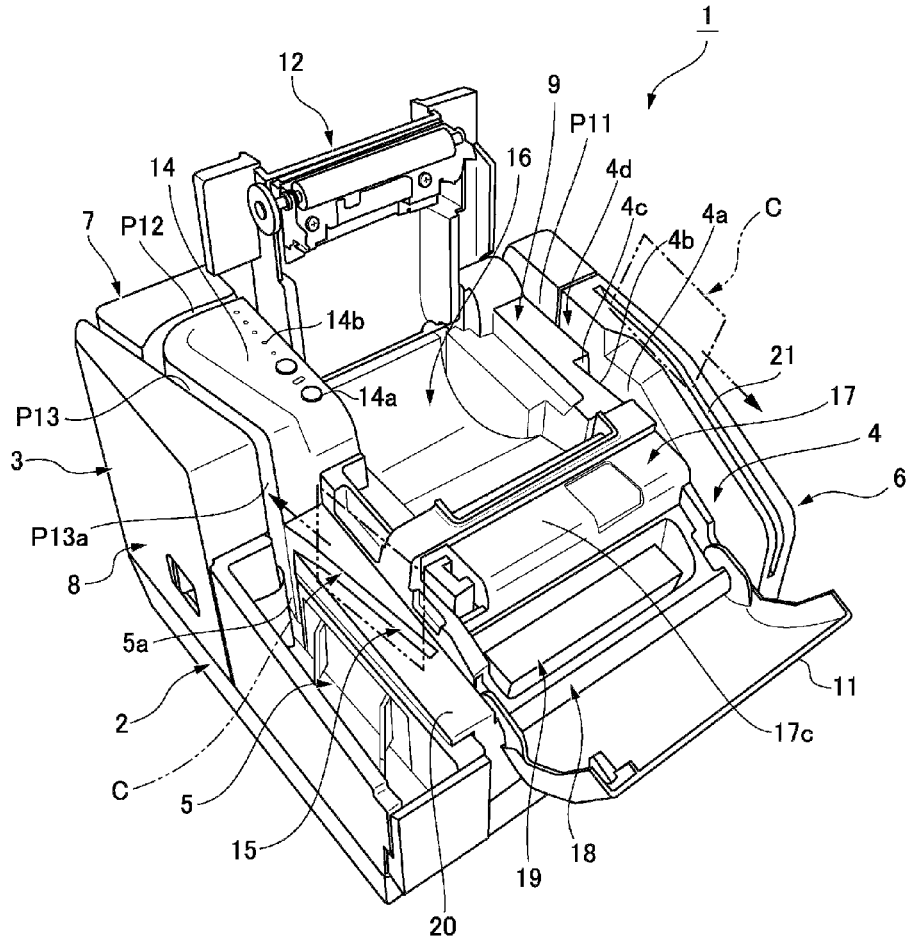
FIG. 2 is a perspective view of the check processing device shown in FIG. 1, showing a state where two upper surface covers thereof are opened.

FIG. 1 is perspective view of a check processing device according to the present embodiment, as seen from obliquely upward on the right front. FIG. 2 is a perspective view of the check processing device as seen from obliquely upward on the left front, showing a state where front and rear covers arranged on an upper surface thereof are opened. Further, FIG. 3 is a perspective view of the check processing device, as seen from the upper front.

With reference to these drawings, a device housing 1*a* of the check processing device 1 includes a lower housing part 2 of a constant thickness which has a rectangular contour and an upper housing part 3 disposed on the lower housing part. The upper housing part 3 is provided with an entrance pocket 4 (medium insertion part) to insert a check S1 to be processed, a check transport path P1 to transport the check S1 fed out from the entrance pocket 4 and a recovery pocket 5 to recovery the check S1 fed out the check transport path P1. While the check is transported along the check transport path P1, reading of magnetic information of the check S1, endorsement printing of the check S1 and reading of image information on both sides of the check S1 are carried out in this order.

A check transport path leads to the recovery pocket 5 through the check transport path. P1 from the entrance pocket 4 and is defined by an longitudinal groove of a predetermined width which is formed on the upper housing part 3 and opened at an upper side of a device's up-down direction Z. As shown in FIG. 1, the check S1 is inserted into the entrance pocket 4 in a standing state where long side edges thereof are in the upper and lower sides, transported through the check transport path P1 still in that state and then discharged to the recovery pocket 5. The check transport path is an approximately U-shaped path which opens to the front of the device, as seen in a plan view.

Figure 3:
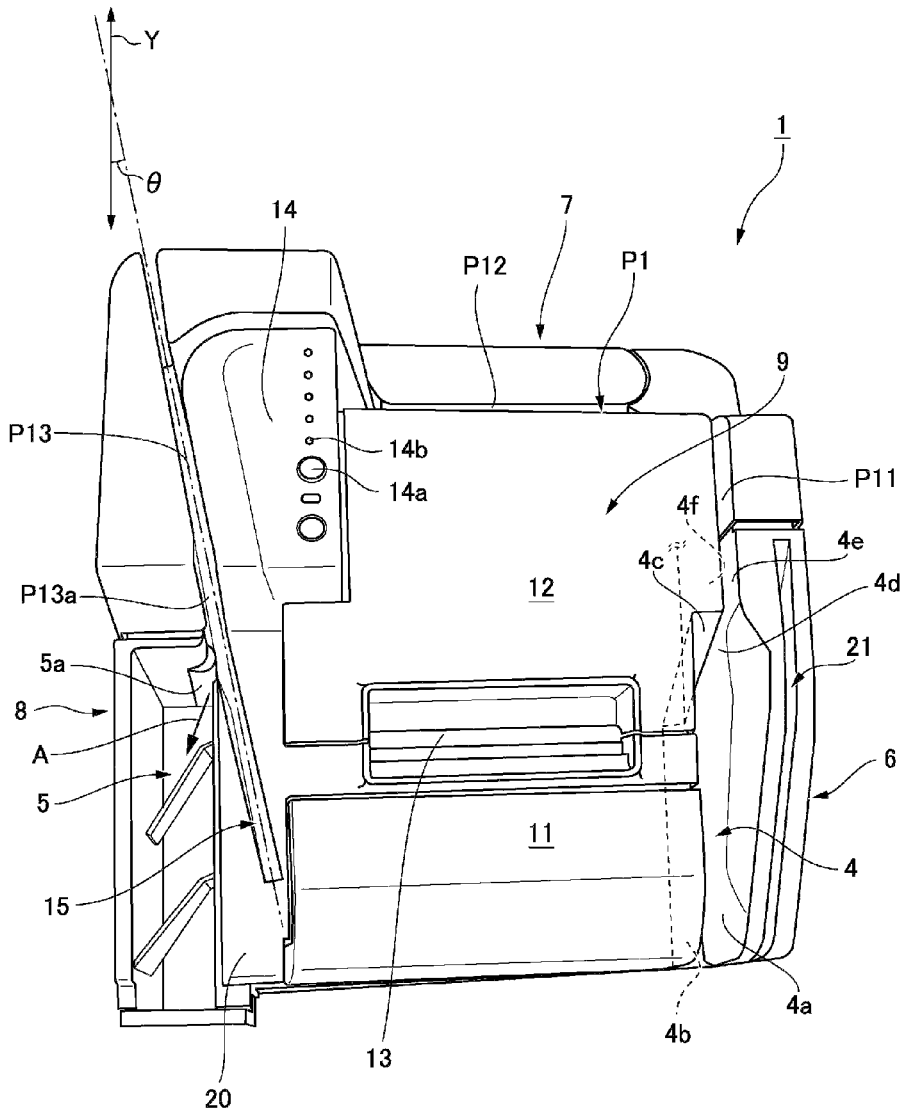
FIG. 3 is a perspective view of the check processing device shown in FIG. 1, as seen from the upper side.

That is, as can be seen from FIG. 3, the entrance pocket 4 extends from a right front end of a width direction X of the device in the upper housing part 3 to the rear of the device and has a substantially constant width. Both sides of the entrance pocket 4 are defined by a first side surface 4*a* and a second side surface 4*b* which confront each other. An end surface 4*c* extends from an end (an end of a check feeding direction) of the second side surface 4*b* at a rear end side of the device toward the first side surface 4*a* in such a way that the end surface is bent at an angle slightly larger than a right angle. A check feeding port 4*d* having a small width is open between an end of the end surface 4*c* and the first side surface 4*a* confronting thereto. Both sides of the check feeding port 4*d* in a width direction are defined by a third side surface 4*e* which extends continuously from the first side surface 4*a* to the rear of the device and a fourth side surface 4*f* which extends substantially parallel to the third side surface 4*e* from the end of the end surface 4*c* toward the rear of the device.

An upstream-side transport path P11 of the check transport path P1 extends linearly from an end of the check feeding port 4*d* at a rear side of the device toward the rear of the device. A downstream end portion of the upstream-side transport path P11 is curved inward in the width direction X of the device and connected to a rear-side transport path P12 of the check transport path P1. The rear-side transport path P12 extends substantially linearly in the width direction of the device. A downstream end portion of the rear-side transport path P12 is curved toward the front of the device and connected to a downstream-side transport path P13 of the check transport path P1. The downstream-side transport path P13 is a linear transport path and extends in a direction which is inclined at an acute angle θ (for example, approximately 10 to 20°) inward in the width direction of the device relative to a front-rear direction Y of the device. A downstream end of the downstream-side transport path P13 is connected to the recovery pocket 5 through a check discharge opening 5*a*. The recovery pocket 5 extends to the front end of the device along the front-rear direction V of the device.

The upper housing part 3 is divided into a right housing portion 6, a rear housing portion 7, a left housing portion 8 and an inner housing portion 9 located inside these housing portions by the U-shaped check transport path. A front cover 11, a rear cover 12, a receipt issuing port 13 of a receipt issuing mechanism (which will be described later) and an operating surface 14 are disposed on an upper surface of the inner housing portion 9. Further, a card insertion path 15 for inserting a card C to be read by a card scanning mechanism (which will be described later) is formed.

As can be seen from FIG. 2, the front cover 12 can be open to the front of the device about a front end region of the device and the rear cover 12 can be open to the rear of the device about a rear end region of the device. The receipt issuing port 13 is formed between an opening/closing side edge of the front cover 11 and an opening/closing side edge of the rear cover 12 and has a rectangular shape which is elongated in the width direction of the device. The operating surface 14 is formed at a rear portion of the device in a left side of the rear cover 12 and is a substantially flat surface which is formed at a position higher than the rear cover by one step. Herein, a plurality of operating switches 14*a*, a plurality of LED display units 14*b* for displaying an operation, etc. are arranged on the operating surface.

A roll paper storage portion 16 is provided at a portion of the inner housing portion 9 which is covered by the rear cover 12. As the rear cover 12 is opened, the roll paper storage portion 16 is opened upward. In this way, it is possible to perform replacement of a roil paper (not shown). An auto-cutter 17 is placed at a portion of the inner housing portion 9 which is covered by the front cover 11. The auto-cutter cuts a continuous paper in a width direction, which is released from the roll paper (not shown) stored in the roll paper storage portion 16. A print head (not shown) is placed below the receipt issuing port 13 and prints information such as the check information on the continuous paper released from the roll paper (not shown) stored in the roll paper storage portion 16. A rear end of the printed portion is cut and thus a receipt of a predetermined length is issued from the receipt issuing port 13. Further, an ink cartridge mounting part 18 is placed at a front side of the auto-cutter 17 and an ink cartridge 19 which is an ink supply source for check printing is mounted on the ink cartridge mounting part 18. As the front cover 11 is opened, a driving unit 17*c* of the auto-cutter 17 is exposed and the ink cartridge mounting part 18 is opened upward. In this way, it is possible to simply perform inspection work of the auto-cutter 17 or replacement work of the ink cartridge from the upper side of the device.

Meanwhile, as can be seen from FIGS. 2 and 3, the card insertion path 15 is formed at a flat device upper surface portion 20 at a left side of the front cover 11 in an upper surface of the inner housing portion 9. The device upper surface portion 20 is located at a position lower than the operating surface 14 at a rear side thereof. The card insertion path 15 is a linear groove which is opened to the upper of the device in the device upper surface portion 20 and has a constant width and a constant depth. A rear end of the card insertion path 15 at the rear of the device is connected to an upper portion of a downstream end opening P13*a* of the downstream-side transport path P13 of the check transport path P1 which is opened to the front of the device. A front end of the card insertion path 15 at the front of the device is located in the vicinity of the side edge of the front cover 11. Further, as can he seen from FIG. 3, the card insertion path 15 is a linear insertion path which extends along an extension line of the downstream-side transport path P13 to the front of the device, which is a linear transport path. That is, the card insertion path 15 extends in a direction which is inclined at the acute angle θ inward the device relative to the front-rear direction Y of the device.

When the image information of the hardly-bendable card C is read out, the card C is inserted to the card insertion path 15 from the front of the device and then pushed to the rear of the device, as shown in FIG. 3. The card C pushed into the card insertion path 15 is fed from the card insertion path 15 to the downstream-side transport path P13 and thus the image information of the card C is read out by an optical reading unit 43 (will be described later, see, FIG. 4) for reading check, which is disposed at the downstream-side transport path P13. The card C after being read out is fed from the downstream-side transport path P13 to the card insertion path 15 at the front of the device.

In the check processing device 1 according to the present example, a card slot 21 is further formed to read out the magnetic information of the hardly-hendahle card C. The card slot 21 is formed at an upper surface portion of the right housing portion 6 of the upper housing part 3. A magnetic reading unit (not shown) is disposed inside the right housing portion 6. As the card C is pulled out along the card slot 21, the magnetic information carried on the card C is read out.

(Internal Configuration)

Figure 4:
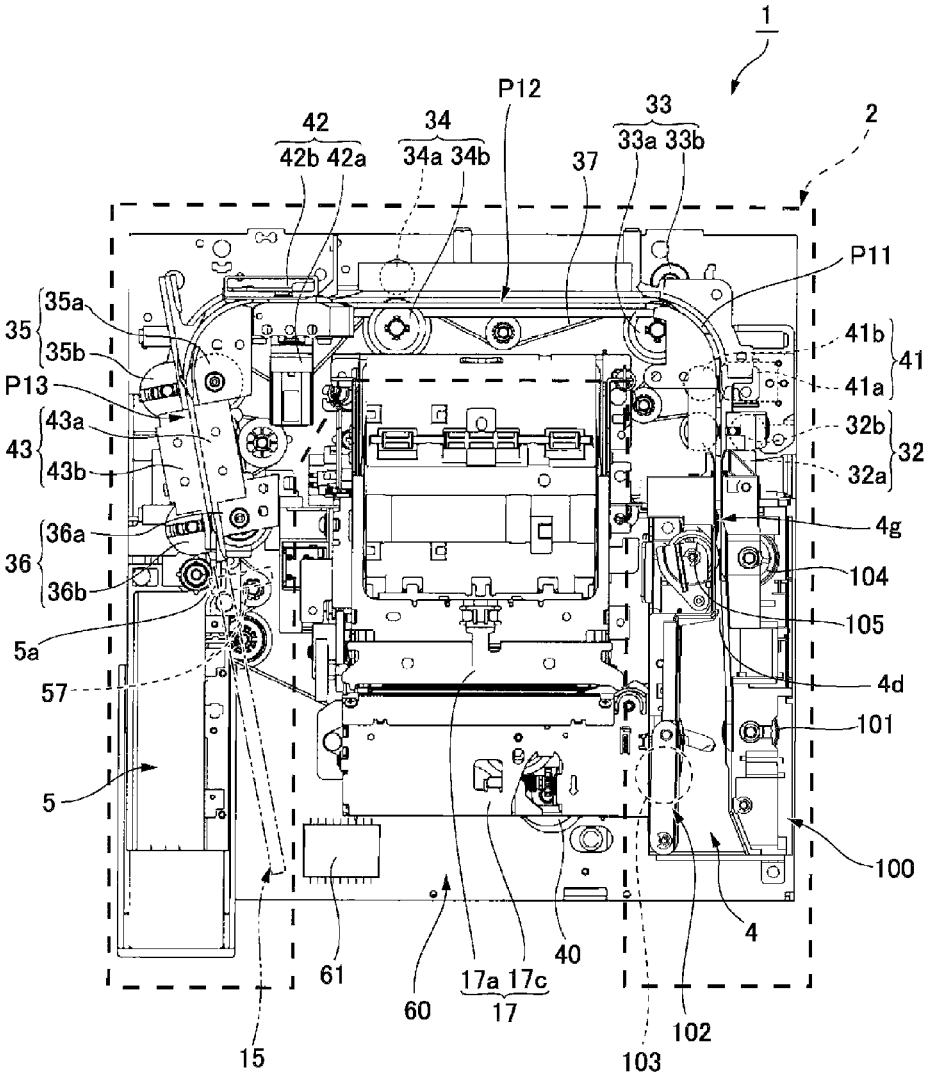
FIG. 4 is a view showing an internal configuration of the check processing device shown in FIG. 1.

FIG. 4 is an internal configuration view showing the essential parts of the check transport mechanism for transporting the check S1 along the U-shaped check transport path. With reference to FIG. 4, a check feeding device 100 (sheet-shaped medium feeding device) including the entrance pocket 4 is incorporated into an upstream end of the check transport path. The check feeding device 100 is configured to separate and feed the check S1 inserted in a state of being overlapped with the entrance pocket 4 one by one to the upstream-side transport path P11. In the present example, the check S1 is inserted to the entrance pocket 4 in a standing state where a back side thereof faces the inside (the inner housing portion 9 side) of the device.

The detailed description of the check feeding device 100 will be described later (see, FIGS. 5A to 7B). Specifically, on the first side 4*a* at the right housing portion 6, a pick-up roller 101 is disposed in a substantially vertical posture with a portion of an outer peripheral surface exposed. A pressing member 102 is disposed in an opening which is formed on the second side surface 4*b* at the inner housing portion 9. The pressing member 102 is intended for pressing the check S1 inserted to the entrance pocket 4 against the pick-up roller 101.

Further, in the check feeding device 100, the pressing member 102 is swiveled from a stand-by position in which the pressing member is retracted to the second side surface 4*b*, toward the pick-up roller 101 at the first side surface 4*a* by a drive motor 103 and presses the check S1 in the entrance pocket 4 against the pick-up roller 101. In addition, the check S1 is fed from the check feeding port 4*d* to the upstream-side transport path P11 of the check transport path P1 by the pick-up roller 101 which is rotationally driven by the same drive motor 103.

On a check feeding passage 4*g* extending from the check feeding port 4*d* of the check feeding device 100, a feeding roller 104 for feeding the check S1 fed out from the entrance pocket 4 and a retard roller 105 facing the feeding roller are disposed. The feeding roller 104 is driven by the drive motor 103. The retard roller 105 is biased toward the feeding roller 104 and subjected to a predetermined rotation load in a check feeding direction. Accordingly, the checks S1 which are squeezed between these rollers and fed out by the feeding roller 104 are separated by the rotation load of the retard roller 105 and thus fed out to the upstream-side transport path P11 one by one even if the checks S1 are fed out in an overlapped state.

Next, a plurality of pairs of transport rollers 32 to 36 is disposed on a transport path of the check S1 fed out from the feeding roller 104. The pair of transport roller 32 is arranged at the upstream-side transport path P11. The check S1 fed out from the feeding roller 104 is squeezed between the pair of transport rollers 32 and transported to the downstream side. The pairs of transport rollers 33, 34 are arranged on the rear-side transport path P12 and the other pairs of transport rollers 35, 36 are arranged on the downstream-side transport path P13. These pairs of transport rollers 32 to 36 respectively include driving rollers 32*a*, 33*a*, 34*a*, 35*a*, 36*a* which are provided to the inner housing portion 9 and driven roller 32*b*, 33*h*, 34*b*, 35*b*, 36*b* which are provided to the right housing portion 6, the rear housing portion 7 and the left housing portion 8 at the outside of the device. The driving rollers are arranged to face the driven rollers through the check transport path P1. The driving rollers 32*a*, 33*a*, 34*a*, 35*a*, 36*a* are rotationally driven by a drive motor 40 and synchronized with each other through an endless belt 37. Further, the driven roller 32*b*, 33*b*, 34*b*, 35*b*, 36*b* are biased toward the opposing driving rollers 32*a* to 36*a* by a biasing member (not shown).

A magnetic reading unit 41 is disposed at the upstream-side transport path P11 of the check transport path P1. The magnetic reading unit 41 includes a magnetic scanner 41*a* such as MICR which is capable of reading out magnetic information written on the check S1 by magnetic ink, etc. The magnetic scanner 41*a* is disposed at the right housing portion 6 in a posture where a magnetic reading surface faces the upstream-side transport path P11. Further, a pressing roller 41*b* is arranged to face the magnetic reading surface of the magnetic scanner 41*a* with the upstream-side transport path P11 sandwiched therebetween. The check S1 to be transported is pressed against the magnetic reading surface of the magnetic scanner 41*a* by the pressing roller 41*b* and thus the magnetic information can be surely read out by the magnetic scanner 41*a*.

On the rear-side transport path P12 extending in the width direction of the device continuously to a downstream end of the upstream-side transport path P11, a check printing unit 42 for carrying out endorsement printing onto the back side of the check S1 is provided at a right corner side of the device. The check printing unit 42 includes a line-type inkjet head 42*a* which are arranged to extend in the up-down direction of the device. A nozzle surface of the inkjet head 42*a* is arranged to face the rear-side transport path P12. On a portion of the rear housing portion 7 facing the nozzle surface with the rear-side transport path P12 sandwiched therebetween, a platen 42*b* for defining a printing position of the inkjet head 42*a* is disposed. As described with reference to FIG. 2, the ink supply source for the inkjet head 42*a* is the ink cartridge 19 mounted on the ink cartridge mounting part 18. It is preferable that the line-type head is employed as in the present example since the check printing unit 42 can be made more compactly than a serial-type inkjet head.

Next, pairs of transport rollers 35, 36 are disposed at the downstream-side transport path P13 of the check transport path P1 and an optical reading unit 43 for reading out image information on both sides of the check S1 is provided at the region of the downstream-side transport path P13 between the pairs of transport rollers 35, 36. The optical reading unit 43 includes an optical scanner 43*a* for reading the back side of the check S1 and an optical scanner 43*b* for reading the front side of the check S1 The reading surfaces of these optical scanners are provided to face each other with the downstream-side transport path P13 sandwiched therebetween.

The downstream end of the downstream-side transport path P13 is connected to the check discharge opening 5*a*. The processed check S1 which has been subjected to reading of magnetic information, endorsement printing and reading of image information is discharged to the recovery pocket 5 through the check discharge opening 5*a*. The recovery pocket 5 is opened upward so that the check S1 recovered into the recovery pocket 5 can be taken out from the upper side. Since both of the entrance pocket 4 and the recovery pocket 5 are opened upward, an operator can handle the check S1 always from the upper front of the check processing device 1.

(Control System and Operation of Check Processing Device)

An operation of the check processing device 1 is controlled by a control unit 61 such as WU. The control unit 61 is mounted on a substrate 60 which is placed on an upper surface of the lower housing part 2, as shown in FIG. 4. Single control unit 61 controls the check processing mechanism, the receipt issuing mechanism and the card scanning mechanism of the check processing device 1 and thus a maintenance performance such as a driver update can be improved. In addition to the control unit 61 mounted on an upper surface of the substrate 60 as shown in FIG. 4, the control unit 61 may be mounted on a back side (a side opposite to a formation side of the check transport path P1) of the substrate 60 as a control substrate.

As the check S1 is inserted into the entrance pocket 4 from the front of the device, the control unit 61 controls driving of the drive motor 103 of the check processing mechanism to cause the pressing member 102 to press the check S1 against the pickup roller 101. In this state, the pick-up roller 101 feeds the check S1 to the check feeding port 4*d* and the feeding roller 104 and the retard roller 105 surely feed the check S1 to the check transport path P1 one by one.

As the check S1 is transported to the upstream-side transport path P11, the control unit 61 first controls the magnetic reading unit 41 to read the magnetic information of the check S1 and to obtain the read magnetic information. Next, the control unit 61 causes the check printing unit 42 to carry out endorsement printing onto the back side of the check S1 on the basis of the read magnetic information. Further, the control unit 61 controls the optical reading unit 43 to read image on both sides of the check S1 and to obtain the read image information. Furthermore, the check S1 of which image information has been read is discharged to the recovery pocket 5 by the pair of transport rollers 36.

In this way, according to the check processing mechanism of the check processing device 1, a series of processes such as reading of magnetic information, endorsement printing and reading of image information can be performed in a batch and thus it is possible to reduce the burden on the user.

(Configuration of the Check Feeding Device)

Figure 5A:
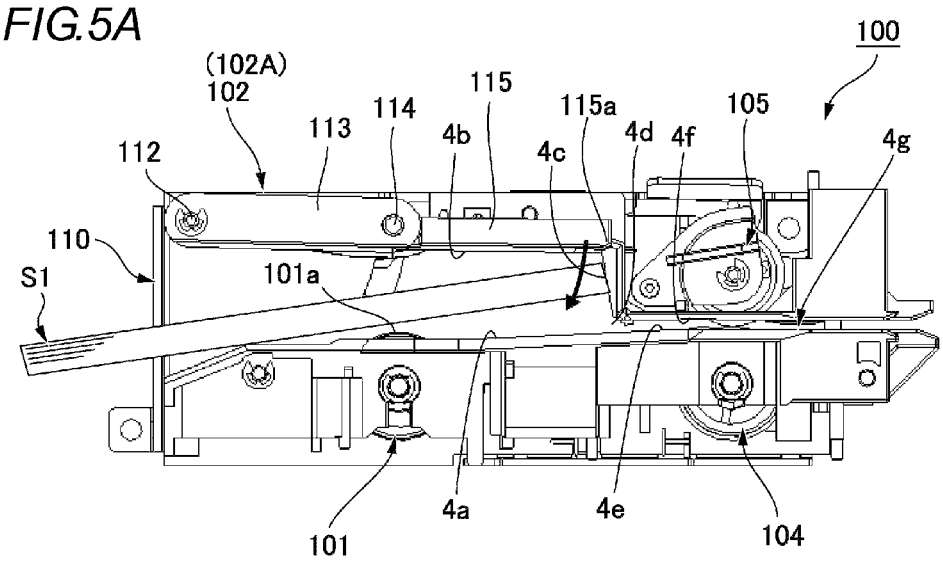
FIGS. 5A and 5B are configuration views showing a mechanism of a check feeding device of the check processing device shown in FIG. 1.
Figure 5B:
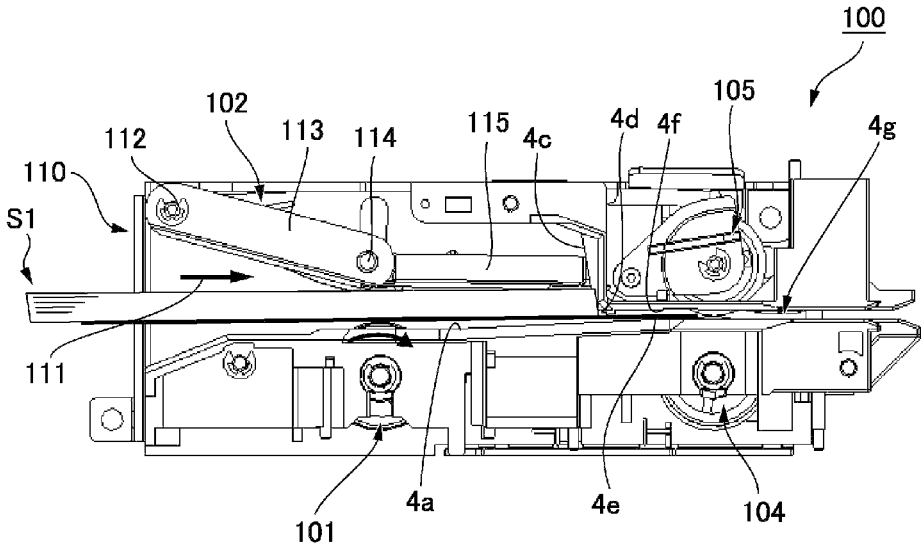

FIGS. 5A and 5B are explanatory views showing a mechanism portion of the check feeding device 100. FIG. 5A shows a state where the check S1 is inserted and the pressing member 102 is in the stand-by position. FIG. 5B shows a state where the pressing member 102 is swiveled to press the check S1 against the pick-up roller 101. Each component of the check feeding device 100 is assembled to a device frame 110. Also, as described above, the pick-up roller 101 is placed at the first side surface 4*a* of the entrance pocket 4 having a large width and the pressing member 102 is placed on the second side surface 4*b* opposite to the first side surface. Further, on the narrow check feeding passage 4*g* opened to an end of the first side surface 4*a* at an end surface 4*c* of the entrance pocket 4 in the check feeding direction, the feeding roller 104 is disposed at the third side surface 4*e* and the retard roller 105 is disposed at the fourth side surface 4*f*.

The pick-up roller 101 is placed at a middle position of the first side surface 4*a* of the entrance pocket 4 in the feeding direction 111 of the check S1 with a portion of an outer peripheral surface 101*a* exposed. The pressing member 102 can be swiveled from a stand-by position (shown in FIG. 5A) toward the pick-up roller 101 (a position shown in FIG. 5B) about a central swivel shall 112. Here, the swivel shaft 112 is placed to extend vertically in the un-down direction of the device at a rear end of the second side surface 4*b* in the feeding direction 111. The pressing member 102 in this example includes a rear side swivel plate 113 of which rear end is pivotably supported by the central swivel shaft 112 and a front side swivel plate 115 of which rear end is pivotably supported about a pivot shaft 114. The pivot shaft is mounted to a leading end of the rear side swivel plate 113. The pressing member 102 is normally biased toward the pick-up roller by a biasing force of a torsion coil spring (not shown) which is mounted on the central swivel shaft 112. Further, the front side swivel plate 115 is held at a state of extending linearly from the rear side swivel plate 113 as shown in FIG. 5A, by a biasing force of a biasing member such as a torsion coil spring (not shown) which is mounted on the pivot shaft 11, for example.

As the drive motor 103 is rotationally driven toward the feeding direction of the check S1, the pressing member 102 is swiveled toward the pick-up roller 101 and thus a leading end 115*a* of the front side swivel plate 115 at a side of a leading end is brought into contact with a leading end portion of a bundle of checks S1 in the feeding direction 111, which has been inserted to the entrance pocket 4. In this way, the check S1 is pushed (approached to) toward the first side surface 4*a* from the side of the leading end. As the pressing member 102 is further swiveled, the front side swivel plate 115 is gradually bent toward the second side surface 4*b* relative to the rear side swivel plate 113 about the pivot shaft 114 and thus a flat side surface 115*b* thereof presses a front side portion of the check S1 against the first side surface 4*a*. Consequently, the bundle of checks S1 are totally pressed against the first side surface 4*a* and in addition, the check S1 of the bundle of checks S1 located at a side of the first side surface 4*a* is pressed against the pick-up roller 101 of which outer peripheral surface is exposed. In this state, if the pick-up roller 101 is rotated, the check S1 is fed out to the check feeding port 4*d* having a small width.

Figure 6A:
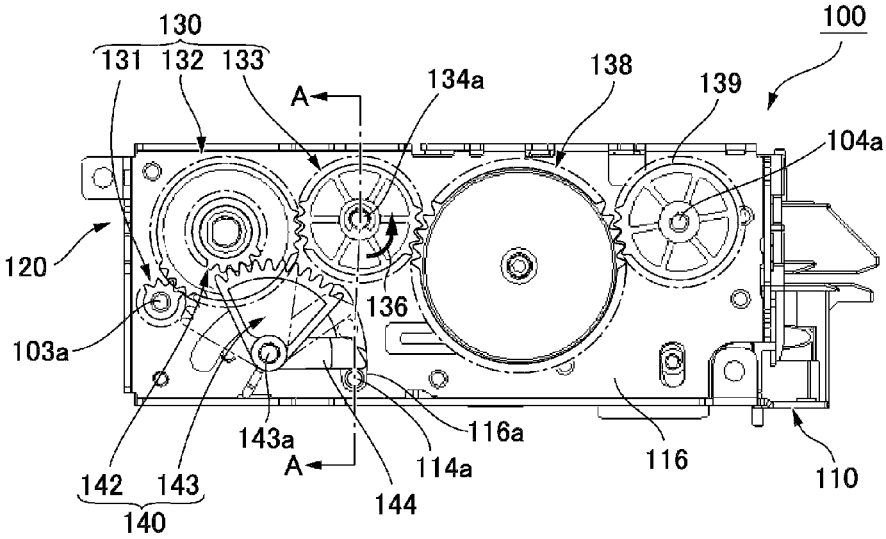
FIGS. 6A and 6B are explanatory views showing a power transmission mechanism of the check feeding device shown in FIGS. 5A and 5B.
Figure 6B:
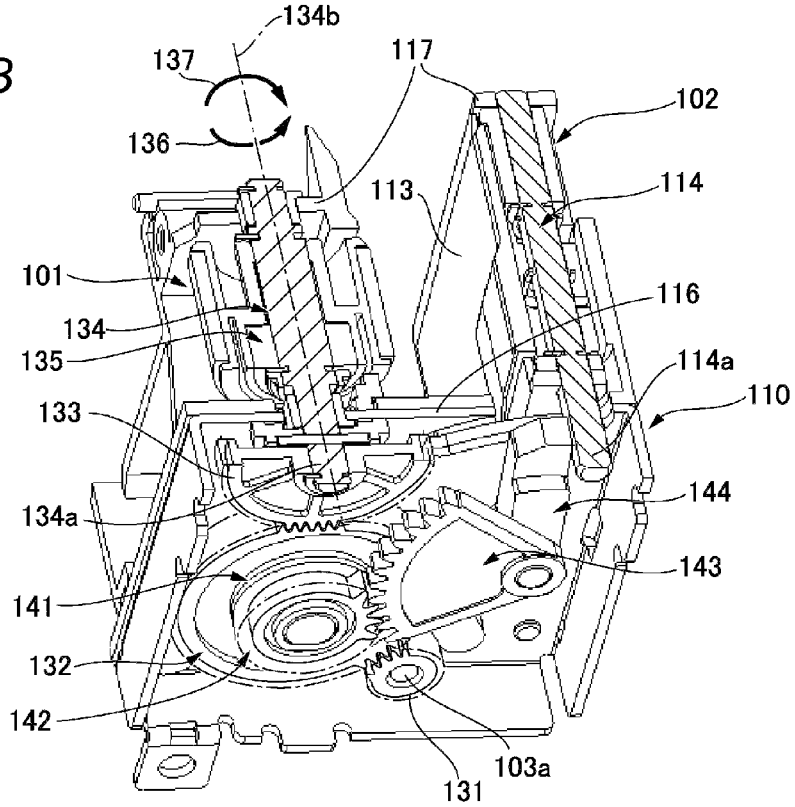

FIGS. 6A and 6B are explanatory views showing a power transmission mechanism of the pick-up roller 101 and the pressing member 102. FIG. 6A shows a gear train for driving the roller and a gear train for driving the pressing member, which are disposed at a back side of a bottom plate of the device frame 110. FIG. 6B is a partial perspective view in a state of being cut in the line A-A.

Figure 7A:
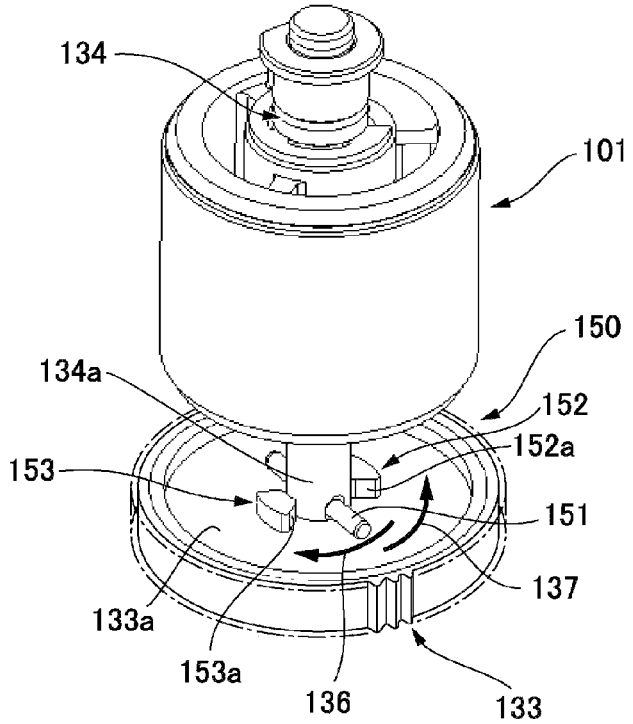
FIGS. 7A and 7B are explanatory views showing a retardation mechanism which is built into the power transmission mechanism shown in FIGS. 6A and 6B.
Figure 7B:
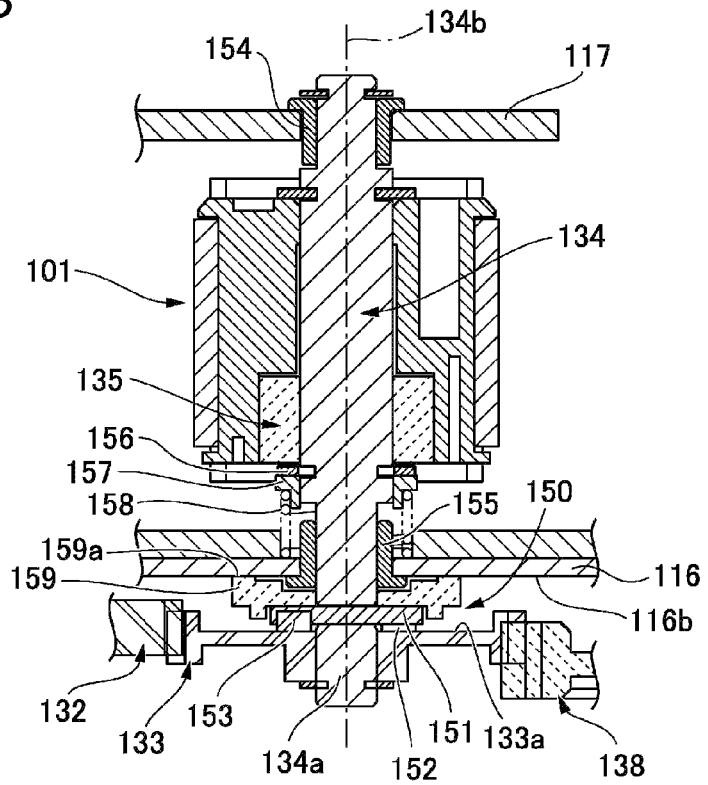

With reference to FIGS. 6A and 6B, a power transmission mechanism 120 includes a gear train 130 for driving the roller to transmit a driving force of the drive motor 103 to the pick-up roller 101 and a gear train 140 for driving the pressing member to transmit the driving force of the drive motor 103 to the pressing member 102. The gear train 130 for driving the roller includes a drive sprocket 131 which is fixedly mounted on a motor shaft 103*a* of the drive motor 103 protruding toward a back side of the bottom plate 116 of the device frame 110. The drive sprocket 131 is meshed with an intermediate transmission gear 132 which is rotatably mounted on the back side of the bottom plate 116. Similarly, the intermediate transmission gear 132 is meshed with a final stage transmission gear 133 which is disposed at the back side of the bottom plate 116. A roller shaft 134 of the pick-up roller 101 is rotatably supported by the device frame 110. The final stage transmission gear 133 is coaxially and rotatably mounted on a shaft end 134*a* of the roller shaft 134 which protrudes from the bottom plate 116 toward the back side. A retardation mechanism 150 is incorporated between the final stage transmission gear 133 and the roller shaft 134 and connects the final stage transmission gear 133 and the roller shaft 134 in a state where these are circumferentially spaced apart from each other with a predetermined play. The retardation mechanism 150 will be described later (see. FIGS. 7A and 7B).

Here, the pick-up roller 101 is connected to the roller shaft 134 via a one-way clutch 135. The one-way clutch 135 transmits a rotation force of the roller shaft 134 to the pick-up roller 101 when the roller shaft 134 is rotated in a predetermined positive rotation direction 136 (rotation direction in which the check S1 is fed out by the pick-up roller 101). In other words, the roller shaft 134 and the pick-up roller 101 are integrally rotated. On the contrary, the rotation force of the roller shaft 134 is not substantially transmitted to the pick-up roller 101 when the roller shaft 134 is rotated in a reverse rotation direction 137 opposite to the positive rotation direction. In order words, the roller shaft 134 idles relative to the pick-up roller 101. And, the pick-up roller 101 can idle relative to the roller shaft 134 in the positive rotation direction when the roller shaft does not rotate.

Next, the gear train 140 for driving the pressing member includes a small-diameter transmission gear 142 which is coaxially connected to the intermediate transmission gear 132 via a one-way clutch 141. A fan-shaped transmission gear 143 having a predetermined angle is meshed with the small-diameter transmission gear 142. The fan-shaped transmission gear 143 is rotatably mounted on the back side of the bottom plate 116 of the device frame 110. A swivel plate 144 extending in a radial direction is fixed to a gear shaft 143*a* of the fan-shaped transmission gear 143. The swivel plate 144 is integrated with the fan-shaped transmission gear 143 and swings about the gear shaft 143*a* in a constant angular range. A lower shaft end 114*a* of the pivot shaft 114 of the pressing member 102 protrudes from the bottom plate 116 of the device frame 110 toward the back side. A leading end of the swivel plate 144 is engaged to the lower shaft end 114*a* of the pivot shaft 114 from a direction perpendicular to a central axis of the pivot shaft 114. The engagement state of the swivel plate 144 and the lower shaft end 114*a* of the pivot shaft 114 is maintained by a spring force of a torsion coil spring (not shown) which is mounted on the central swivel shaft 112 of the pressing member 102, for example. Further, an arc-shaped groove 116*a* is formed on the bottom plate 116. The arc-shaped groove 116*a* is formed in an angle including a moving range of the lower shaft end 114*a* and has a constant width. The pivot shaft 114 which is swiveled by the swivel plate 144 slides along the arc-shaped groove 116*a*.

The final stan transmission gear 133 of the gear train 130 for driving the roller is meshed with a large-diameter transmission gear 138 which is rotatably mounted on the back side of the bottom plate 116 of the device frame 110. The large-diameter transmission gear 138 is meshed with a transmission gear 139 which is fixedly mounted on a shaft end of a roller shaft 104*a* of the feeding roller 104. Accordingly, a driving force of the drive motor 103 is transmitted to the feeding roller 104.

Next. FIGS. 7A and 7B are views showing the retardation mechanism 150. FIG. 7A is a perspective view thereof and FIG. 7B is a longitudinal sectional view. With reference to FIGS. 6A, 6B, 7A and 7B, the retardation mechanism 150 includes an engaging pin 151 having a predetermined length. The engaging pin 151 extends in a radial direction and is fixed to the shaft end 134*a* of the roller shaft 134 (driven side rotational member) which protrudes from the bottom plate 116 of the device frame 110 toward the back side. The engaging pin 151 extends through a center of the shaft end 134*a* and protrudes from both sides of the shaft end 134*a* in the radial direction by the same length.

Further, the retardation mechanism 150 includes a pair of fan-shaped protrusions 152, 153 having a constant angle. The pair of fan-shaped protrusions 152, 153 are fixed to an end surface 133*a* (an end surface on the side facing the engaging pin 151) of the final stage transmission gear 133 (driving side rotational member) facing upward. The fan-shaped protrusion 152 is formed with a first engaging surface 152*a* which is vertically erected from the end surface 133*a* of the final stage transmission gear 133. The other fan-shaped protrusion 153 is formed at its first engaging surface 152*a* side with a second engaging surface 153*a* which is vertically erected from the end surface 133*a* of the final stage transmission gear 133. An angle of the first and second engaging surfaces 152*a*, 153*a* around a rotational center axis 134*b* is set as a play angle.

As can be seen from FIG. 7A, when the final stage transmission gear 133 rotates in the positive rotation direction 136 by the play angle from a state where the engaging pin 151 is engaged with the second engaging surface 153*a*, the first engaging surface 152*a* is engaged with the engaging pin 151 and thus the engaging pin 151 is integrally rotated in the same positive rotation direction 136. On the contrary, when the final stage transmission gear 133 rotates in the reverse rotation direction 137 opposite to the positive rotation direction 136 by the play angle from a state where the engaging pin 151 is engaged with the first engaging surface 152*a*, the second engaging surface 153*a* is engaged with the engaging pin 151 and thus the engaging pin 151 is integrally rotated in the same reverse rotation direction 137. Accordingly, after the rotation in the reverse rotation direction 137 is ended, the first engaging surface 152*a* and the second engaging surface 153*a* are held in a state where a constant play angle is always formed therebetween.

Here, the retardation mechanism 150 in this example is provided with a mechanism for preventing the engaging pin 151 (at the side of the pick-up roller 101) from rotating in interlock with the final stage transmission gear 133 at a driving side before the first engaging surface 152*a* of the final stage transmission gear 133 is engaged with the engaging pin 151. With reference to FIG. 7A, the roller shaft 134 of the pick-up roller 101 is rotatably supported through bearing sleeves 154, 155 which are mounted on an upper plate 117 and the bottom plate 116 of the device frame 110. Further, at the side of a lower end surface of the pick-up roller 101, a spring seat 157 is attached to a lower surface of a retaining ring 156 which is fixed to the roller shaft 134. A compression coil spring 158 is mounted between the spring seat 157 and the upper surface of the bottom plate 11 of the device frame 110 in a state of concentrically surrounding the roller shaft 134.

A disc-shaped flange 159 is press-fitted into a part of the upper side than the engaging pin 151, of the shaft end 134*a* of the roller shaft 134 which protrudes from the bottom plate 116 toward the back side. The roller shaft 134 is biased upward relative to the bottom plate 116 by the compression coil spring 158. Owing to such a biasing force, an upper end surface 159*a* of the flange 159 which is fixedly press-fitted into the roller shall 134 is pressed against a back side 116*b* of the bottom plate 116. A rotation restraint force of a predetermined size which restrains rotation of the roller shaft 134 is acting on the roller shaft 134, due to a frictional resistance between an end surface 159*a* of the flange 159 and the back side 116*a* of the bottom plate 116.

The size of the rotation restraint force is set enough to prevent the engaging pin 151 (roller shaft 134) from rotating in interlock with the final stage transmission gear 133 until the final stage transmission gear 133 starts to rotate in the positive rotation direction 136 and thus the first engaging surface 152*a* is engaged with the engaging pin 151. That is, it is intended that no rotation of the pick-up roller 101 is started until the final stage transmission gear is rotated by the play angle (until the pressing member 102 starts to move and then a predetermined retard time has been elapsed). Since the compression coil spring 158 (rotation restraint member) is provided, rotation start timing of the pick-up roller 101 can be always set at an appropriate timing.

(Operation of Check Feeding Device)

Operation of each part in the check feeding device 100 thus configured is summarized below. First, when the drive motor 103 starts to rotate in the feeding direction of the check S1, the pressing member 102 starts to move from the stand-by position 102A and to press the check S1, in synchronous with rotation of the drive motor. In contrast, the rotation start timing of the pick-up roller 101 is retarded by the retardation mechanism 150. That is, after the final stage transmission gear 133 is rotated by the play angle in the positive rotation direction 136 by the retardation mechanism 150, the final stage transmission gear 133 is connected to the roller shaft 134. From this timing, the roller shaft 134 is integrated with the final stage transmission gear 133 to rotate in the positive rotation direction 136.

As a result, after a predetermined delay time from the start of movement of the pressing member 102, the pick-up roller 101 is integrated with the roller shaft 134 through the one-way clutch 135 and starts to rotate in the positive rotation direction 136, and thus a feeding operation of the check S1 is started. At this time, the check S1 is in a state of being approached near the check feeding port 4*d* by the pressing member 102. Therefore, it is possible to avoid an adverse effect that the tip of the feeding direction of the check S1 fed by the pick-up roller 101 abuts against the end surface 4*c* of the entrance pocket 4 and thus the check S1 cannot be fed out from the check feeding port 4*d*. Further, as the pressing member 102 moves and thus the check S1 is approached near the pick-up roller 101, the small-diameter transmission gear 142 becomes an idling state by the one-way clutch 141 and thus there is no case that an excessive force is exerted on the gear train 140 for driving the pressing member or the pressing member 102. In this way, the pressing member 102 presses the check S1 with a constant biasing force.

The check S1 fed out from the check feeding port 4*d* by the pick-up roller 101 passes between the feeding roller 104 and the retard roller 105 which start to rotate in synchronous with the drive motor 103 and then is fed out to the check transport path. Then, the check S1 is sent to the pair of transport rollers 32 which is placed at an upstream end of the check transport path. At this time, the pair of transport rollers 32 is in a state of rotating in a constant speed and the fed check S1 is fed out to the downstream side by the pair of transport rollers 32.

When the check S1 is sent to the pair of transport rollers 32, the drive motor 103 is stopped and the rotation of the pick-up roller is also stopped. At this time, a rear side of the check S1 to be fed out is in a state of being pressed against the pick-up roller 101 by the pressing member 102. However, the pick-up roller 102 is connected to the roller shaft 134 via the one-way clutch 135 and thus is rotated in interlock with the check S1 drawn by the pair of transport rollers 32. Accordingly, there is no case that a large transport load is acting on the pair of transport rollers 32 to disrupt the transport of the check S1.

In a case where the check S1 is continuously transported, the drive motor 103 starts to drive at a predetermined timing and thus a feeding operation of next check S1 is performed, every time when the transport of a sheet of check S1 is completed. At this time, the check S1 is in a state of being pressed against the pick-up roller 101 by the pressing member 102 and the engaging pin 151 is in a state of being engaged with the first engaging surface 152*a* of the retardation mechanism 150. Accordingly, as the drive motor starts to rotate, the pick-up roller 101 starts to rotate in synchronous with rotation of the drive motor and thus a feeding operation of the check S1 is performed. Consequently, according to the retardation mechanism 150 of the present example, there is no case that the pick-up roller 101 is unnecessarily retarded and thus rotation start timing is delayed. Accordingly, the feeding operation of the check can he effectively performed without a loss time in a continuous feeding operation of the checks.

Next, after the feeding of the check S1 is completed, the drive motor 103 is rotationally driven in a direction opposite to the rotation direction at the time of feeding out the check S1. In this case, as the drive motor 103 starts to rotate, the pressing member 102 starts to retract toward the stand-by position 102A against the biasing force. In contrast, at a side of the gear train 130 for driving the roller, the final stage transmission gear 133 is rotated in the reverse rotation direction 137 and thus the first engaging surface 152*a* in the retardation mechanism 150 starts to rotate in a direction spaced away from the engaging pin 151. As a result, the first engaging surface 152*a* rotates in a direction spaced away from the engaging pin 151 and the engaging pin 151 is engaged with the second engaging surface 153*a* and then the final stage transmission gear 133 and the roller shaft 134 are integrally rotated in the reverse rotation direction 137. The drive motor 103 is stopped when the pressing member 102 returns to the stand-by position 102A. For example, the drive motor 103 is stopped when it is detected by a sensor (not shown) that the pressing member 102 returns to the stand-by position 102A. At this time, since the engaging pin 151 is engaged with the second engaging surface 153*a*, a state where the first engaging surface 152*a* returns to a rotation position spaced away from the engaging pin 151 by a play angle is maintained. As a result, the play is secured when next check feeding operation is started (retardation time is secured).

What is claimed is:

1. A sheet-shaped medium feeding device comprising:

a medium insertion part configured to insert a sheet-shaped medium therethrough;

a medium feeding port located at an end surface of the medium insertion part at a feeding side of the sheet-shaped medium, the medium feeding port having a width narrower than a width of the medium insertion part;

a pick-up roller configured to feed the sheet-shaped medium inserted into the medium insertion part to the medium feeding port;

a pressing member configured to press the sheet-shaped medium against the pick-up roller;

a drive motor; and a power transmission mechanism configured to transmit a driving three of the drive motor to the pick-up roller and the pressing member, wherein the power transmission mechanism includes a retardation mechanism configured to retard rotation start timing of the pick-up roller than movement start timing of the pressing member when the pressing member starts to move from a stand-by position of the pressing member toward the pick-up roller, wherein the retardation mechanism includes a driving side rotational member and a driven side rotational member which are configured to rotate around a common center axis, wherein when the driving side rotational member rotates around the center axis in a predetermined rotation direction by a predetermined play angle, the driving side rotational member is engaged with the driven side rotation & member to integrally rotate the driven side rotational member in the rotation direction, wherein the medium insertion part includes a first side surface from which a portion of an outer peripheral surface of the pick-up roller is exposed, and wherein the predetermined play angle of the retardation mechanism corresponds to a rotation amount of the driving side rotational member which is required to move the pressing member from the stand-by position to the first surface in a width direction of the medium insertion part.

2. The sheet-shaped medium feeding device according to claim 1, wherein both sides of the medium insertion part in a width direction thereof are defined by a first side surface and a second side surface which confront each other, wherein both sides of the medium feeding port are defined by a third side surface and a fourth side surface which confront each other, wherein the third side surface extends continuously to the first side surface, wherein the fourth side surface extends in a feeding direction of the sheet-shaped medium from a leading end of an end surface which is bent and extends toward the first side surface from an end of the second side surface at the medium insertion part, wherein the pressing member is movable from the stand-by position in which the pressing member is retracted toward the second side surface from the pick-up roller, toward the portion of the outer peripheral surface of the pick-up roller which is exposed at the first side surface, wherein the pressing member includes a rear side swivel plate having a rear end that is pivotably supported be a central swivel shaft, and a front side swivel plate having a rear end that is pivotably supported about a pivot shaft disposes at a front end of the rear side swivel, and wherein when the pressing member is disposed at the stand-by position, the front side swivel plate and the rear side swivel plate are aligned and the pivot shaft is disposed between a front end of the front side swivel plate and the rear end of the rear side swivel plate in the feeding direction.

3. The sheet-shaped medium feeding device according to claim 1, wherein the driven side rotational member is a roller shaft of the pick-up roller, wherein the driving side rotational member is a final stage transmission gear of a roller driving gear train which transmits the driving force of the drive motor of the power transmission mechanism to the roller shaft, wherein the final stage transmission gear is rotatably mounted on the roller shaft, wherein the roller shaft is mounted with an engaging pin extending in a radial direction of the roller shaft, and wherein a first engaging surface and a second engaging surface which are engagable with the engaging pin are formed at positions spaced apart around the rotation center axis by the play angle on an end surface of the final stage transmission gear, which confronts the engaging pin.

4. The sheet-shaped medium feeding device according to claim 3, further comprising a rotation restraint member configured to apply a rotational load to the roller shaft which is mounted with the engaging pin, in a direction to prevent the engaging pin from rotating in interlock with the final stage transmission gear until the final stage transmission gear starts to rotate and then the first engaging surface is engaged with the engaging pin.

5. The sheet-shaped medium feeding device according to claim 3, wherein the pick-up roller is mounted to the roller shaft via a first one-way clutch, wherein the first one-way clutch is configured to transmit a rotation force for rotating the pick-up roller in a feeding direction of the sheet-shaped medium from the roller shaft to the pick-up roller, wherein the power transmission mechanism includes a pressing member side transmission gear which is connected to a transmission gear of the roller driving gear train, other than the final stage transmission gear via a second one-way clutch so as to integrally rotate therewith, and wherein a rotation force for moving the pressing member is transmitted to the pressing member via the pressing member side transmission gear.

6. A sheet-shaped medium processing device comprising:

the sheet-shaped medium feeding device according to claim 1;

a medium transport mechanism configured to transport the sheet-shaped medium fed out from the sheet-shaped medium feeding device along a predetermined transport path; and an information reading unit configured to read out information carried on the sheet-shaped medium which is transported in the transport path.

7. A sheet-shaped medium feeding device comprising:

a medium insertion part configured to insert a sheet-shaped medium therethrough;

a medium feeding port located at an end surface of the medium insertion part at a feeding side of the sheet-shaped medium, the medium feeding port having a width narrower than a width of the medium insertion part;

a pick-up roller configured to feed the sheet-shaped medium inserted into the medium insertion part to the medium feeding port;

a pressing member configured to press the sheet-shaped medium against the pick-up roller;

a drive motor; and a power transmission mechanism configured to transmit a driving force of the drive motor to the pick-up roller and the pressing member, wherein the power transmission mechanism includes a retardation mechanism configured to retard rotation start timing of the pick-up roller than movement start timing of the pressing member when the pressing member starts to move from a stand-by position of the pressing member toward the pick-up roller, wherein the retardation mechanism includes a driving side rotational member and a driven side rotational member which are configured to rotate around a common center axis, wherein when the driving side rotational member rotates around the center axis in a predetermined rotation direction by a predetermined play angle, the driving side rotational member is engaged with the driven side rotational member to integrally rotate the driven side rotational member in the rotation direction, wherein the medium insertion part includes a first side surface from which a portion of an outer peripheral surface of the pick-up roller is exposed, wherein the predetermined play angle of the retardation mechanism corresponds to a rotation amount of the driving side rotational member which is required to move the pressing member from the stand-by position to the first side surface in a width direction of the medium insertion part, wherein the pressing member includes a rear side swivel plate having a rear end that is pivotably supported by a central swivel shaft, and a front side swivel plate having a rear end that is pivotably supported about a pivot shaft disposed at a front end of the rear side swivel, and wherein when the pressing member is disposed at the stand-by position, the front side swivel plate and the rear side swivel plate are aligned and the pivot shaft is disposed between a front end of the front side swivel plate and the rear end of the rear side swivel plate in the feeding direction.

8. The sheet-shaped medium feeding device according to claim 1, wherein both sides of the medium insertion part in a width direction thereof are defined by a first side surface and a second side surface which confront each other, wherein both sides of the medium feeding port are defined by a third side surface and a fourth side surface which confront each other, wherein the third side surface extends continuously to the first side surface, wherein the fourth side surface extends in a feeding direction of the sheet-shaped medium from a leading end of an end surface which is bent and extends toward the first side surface from an end of the second side surface at the medium insertion part, wherein a portion of an outer peripheral surface of the pick-up roller is exposed from the first side surface, wherein the pressing member is movable from the stand-by position in which the pressing member is retracted toward the second side surface from the pick-up roller, toward the portion of the outer peripheral surface of the pick-up roller which is exposed at the first side surface, and wherein the pressing member includes a rear side swivel plate having a rear end that is pivotably supported by a central swivel shaft, and a front side swivel plate having a rear end that is pivotably supported about a pivot shaft.

9. The sheet-shaped medium feeding device according to claim 1, wherein the pressing member is pivotably supported by a central swivel shaft which is disposed at a medium insertion part side of the sheet-shaped medium feeding device.

* * * * *